United States Patent [19]

Harper

[11] 4,077,077

[45] Mar. 7, 1978

[54] STABILIZER KEEL

[76] Inventor: Alex M. Harper, N. 7007 Jefferson, Spokane, Wash. 99208

[21] Appl. No.: 759,236

[22] Filed: Jan. 13, 1977

[51] Int. Cl.[2] ..... A63C 5/00

[52] U.S. Cl. ..... 9/310 A; 114/140; 114/274

[58] Field of Search ..... 9/310 R, 310 A, 310 B, 9/310 E; 114/126, 127, 129, 132, 133, 135, 136, 137, 140, 143, 149, 170, 274, 275, 280, 282, 284, 285, 286, 287, 305

[56] References Cited

U.S. PATENT DOCUMENTS

| | | | |
|---|---|---|---|
| 1,452,790 | 4/1923 | Claupin | 9/305 |
| 3,087,173 | 4/1963 | Meyer | 9/310 A |
| 3,090,978 | 5/1963 | Hanson | 9/310 A |
| 3,170,432 | 2/1965 | Roper | 114/280 |
| 3,395,410 | 8/1968 | Rutland et al. | 9/310 A |
| 3,516,100 | 6/1970 | Ellis | 9/310 E |
| 3,802,369 | 4/1974 | Ishimoto | 114/282 |

FOREIGN PATENT DOCUMENTS

| | | | |
|---|---|---|---|
| 266,680 | 1/1964 | Australia | 114/126 |
| 365,297 | 12/1962 | Switzerland | 114/143 |

*Primary Examiner*—Trygve M. Blix
*Assistant Examiner*—Edward R. Kazenske
*Attorney, Agent, or Firm*—Wells, St. John & Roberts

[57] ABSTRACT

A stabilizer keel for water surface vehicles. The keel includes a pair of pivoted keel plates that are pivoted on a stationary base member by an integral hinge. The plates are urged apart about the axis of the hinge to normally form a V-configuration for the purpose of stabilizing the object to which the keel is mounted; for example, a water ski. The hinge axis is inclined so the plates, when in the open, V-configuration, will lift upwardly against the ski upon movement of the ski in a forward direction. As forward velocity is increased, pressure against the plates also increases, causing them to swing inwardly against resistance of the spring. Thus, at relatively high speeds, the plates come together to form a substantially standard shaped keel.

8 Claims, 6 Drawing Figures

STABILIZER KEEL

BACKGROUND OF THE INVENTION

The present invention is related to stabilizing keels and particularly to such keels utilized for stabilizing water vehicles, particularly water skis.

The present invention was conceived to enable a novice water skier to quickly learn to ski with one or two skis. Two common problems exist for beginning skiers. The first is the difficulty most beginning skiers experience in holding the tip of the ski down during initial takeoff. The second problem is to keep the ski level and pointed toward the towing boat until enough speed is achieved to bring the ski to the water surface.

The present invention aids the novice skier in both of the above situtations. Firstly, the normally V-shaped plates assist the skier in holding the tip of the ski down. This is because the plates, at low speed, are separated and inclined to produce an upward force against the rearward ski end. Consequently, a downward force is applied to the forward ski end. Further, while the ski is moving at low speeds, the plates are held apart in the V-shaped orientation. This effectively stabilizes the ski, pointing it in the direction of the towing force. Once sufficient speed is built up, the spring allows the plates to close together and form a substantially normal keel configuration. It has also been found that the present keel structure aids in guiding the ski through high speed turns. In a turn, the blade portion facing the outside of the turn will open slightly, creating a resistance. This resistance tends to pull the ski in the direction of the turn.

U.S. Pat. No. 3,201,807 granted to G. R. Weaver on Aug. 24, 1965 discloses a ski stabilizer. This device is comprised of two interconnected keel elements. The elements are connected along the horizontal line and diverge outward and downwardly. There is no V configuration wherein the plates converge forwardly such that a centering stabilizing effect is given to the water ski. The function of Weaver's inverted V-shaped stabilizer members is to enable the skier to lean and tilt the ski laterally while still maintaining at least one of the stabilizer members in a position of substantial control. The plates are angularly separated such that the skier may turn in either direction and still maintain a substantial degree of control of the ski. This device, while most likely very useful to experienced "slalom" skiers, is not intended for the purpose of teaching and assisting novice skiers.

A different problem is recognized in the J. H. Martin, Jr. U.S. Pat. No. 3,103,673 granted on Sept. 17, 1963. Martin discloses a water ski attachment that is utilized for the purpose of stabilizing the ski when the forward end thereof is held in an upward position relative to the water surface. A hydrodynamic means is provided to increase the "tractive efficiency of the water ski during its movement through the water". The means (comprised of an angular tube arranged on the keel member so as to take water in at a lower intake end and discharge the water at an upwardly disposed end) assist in holding the rearward end of the ski in a downward position as opposed to an elevated condition of the forward end.

A somewhat similar device is disclosed in the G. H. May U.S. Pat. No. 3,089,157, granted on May 14, 1963. May, however, utilizes a tunnel shaped stabilizer that is held in a horizontal condition parallel with the bottom, water engaging surface of the attached ski. The purpose of this fin is to provide a similar degree of control to the skier while eliminating the normal blade type keel that has been known to be hazardous to swimmers and fallen skiers.

U.S. Pat. No. 3,090,978 granted on May 28, 1963 to W. H. Hanson discloses a water ski device wherein horizontally retractable stabilizing members are provided and actuated by the heel of the skier. The stabilizing devices pivot about vertical axes (perpendicular to the bottom surface of the ski) between retracted positions on the top surface of the ski to laterally extended positions wherein the extended fins may engage and provide some control in assisting the skier to move to an upright condition from a substantially submerged starting position. The laterally extending plates serve to push the forward end of the ski downward and produce a lifting moment against the rear of the ski. It thereby assists movement of the skier to an upright position. It is claimed that the device enables slalom type skiing behind relatively underpowdered boats that were previously incapable of pulling a "slalom skier" to an upright position.

SUMMARY OF THE INVENTION

The present stabilizer keel described herein includes a stationary base member that is adapted for mounting to a flat surface. The base member includes a leading edge and a trailing edge. A pair of keel plates are hinged together and pivotally mounted to the keel base member. The plates pivot about the hinge axis rearwardly adjacent to the leading edge of the base member. The hinge axis is located within a plane that longitudinally bisects the base member such that the keel plates will pivot outwardly therefrom at equal and opposite angles, forming a V configuration. Biasing means is provided between the keel plates to normally urge the plates apart to the V configuration.

It is a first object of the present invention to provide a stabilizer keel assembly that will actively operate to hold the device, such as a water ski, stable during forward movement through water.

It is a further object to provide such a stabilizing keel that may be effectively utilized to assist novice skiers in learning the technique of "slalom" water skiing.

A still further object is to provide such a stabilizer keel that will not create a substantial drag and that will fold to a substantially flat configuration once it reaches a prescribed forward velocity through the water.

A still further object is to provide such a stabilizer keel that may be attached to a water ski for the purpose of assisting the skier in turning movements made while slalom skiing at relatively high speeds.

A still further object is to provide such a stabilizer keel that will produce a lifting force at the rearward end of a ski and thereby assist quick movement of the skier to an upright condition, thereby reducing the drag and horsepower requirements of the towing vehicle.

These and still further objects and advantages will become apparent upon reading the following description which, taken with the accompanying drawings, disclose a preferred form of my invention. However, it is not intended that the description and drawings be taken as strict representations of the scope of my invention. Only the claims to be found at the end of this specification are given as definitions that place restrictions upon the scope of my invention.

DETAILED DESCRIPTION OF A PREFERRED EMBODIMENT

Figure 1:
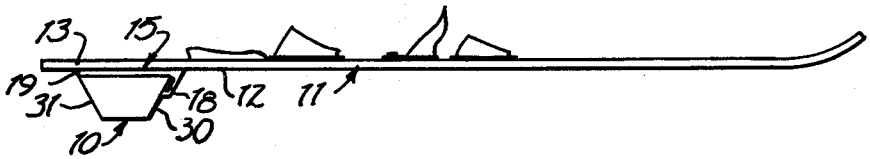
FIG. 1 is an elevational view of a water ski with the present keel structure mounted thereon.

The present stabilizer keel is generally indicated in the drawings by the reference character 10. The keel 10 is shown mounted to a water ski 11 (FIG. 1). Although it is intended that the present keel be utilized for purposes primarily with water skis, it is understood the keel could also be utilized with other water vehicles such as surf boards and possibly even motor and sailboats.

The keel structure, as shown, is mounted to the planar bottom surface 12 of ski 11. Its location is at the rearward ski end 13 so as to provide substantial longitudinal stability to the ski at an area where the ski is nearly always in contact with the water surface. Function of the keel member in relation to the water ski will be described following a more detailed description of the elements incorporated in the present invention.

The keel structure 10 includes a fixed stationary base member 15 that is adapted to be mounted to a flat surface such as the ski bottom 12. The base member 15 includes a flat mounting plate 16 for this purpose. Screws 17 may be utilized to attach the plate 16 to the ski bottom 12 or other appropriate fastening mechanism may be provided that are presently known and commonly utilized for such purposes.

Figure 2:
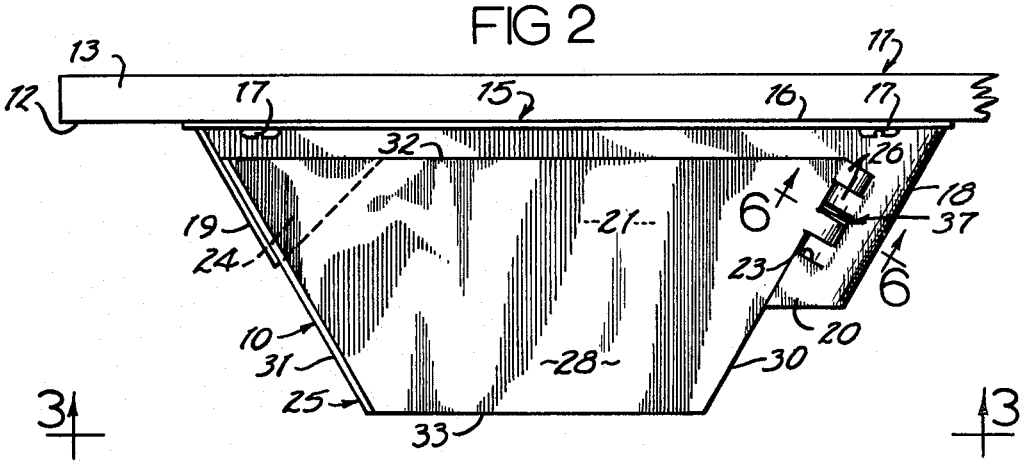
FIG. 2 is an enlarged fragmentary view of a portion of the ski showing my stabilizer keel in greater detail.

The base member 15 is elongated and includes a leading edge 18 and trailing edge 19 that are within a plane substantially perpendicular to the mounting plate 16. Edges 18 and 19 are positioned so they will be longitudinally oriented along the length of the ski 11 or other water vehicle to which the present keel is to be attached. The edges 18 and 19 define opposite upright side base surfaces 20. The surfaces, as shown by dashed lines in FIG. 2, are not continuous along the length of the base member between edges 18 and 19. Instead, there is a relief area 21 located intermediate the edges 18 and 19. A forward portion of the relief area 21 includes a hinge receiving recess 23. (FIG. 2). A rearward portion 24 of base member is defined on a rearward side by edge 19 and on a forward side by relief area 21.

Figure 6:
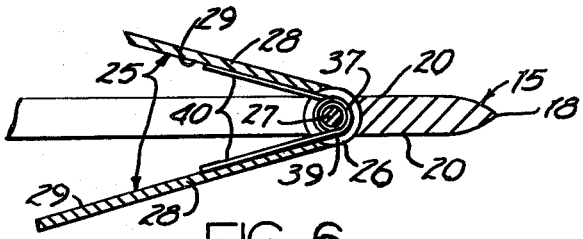
FIG. 6 is an enlarged fragmentary section view taken substantially along line 6—6 in FIG. 2 showing the plates in an open condition.

A pair of keel plates 25 are hinged to the base 15. They include forward hinge members 26 that are joined together and pivotally attached to the base member 15 by a pin 27 (FIG. 6). Hinge members 26 are received within the hinge recess 23 in base member 15. Provision is made such that the axis for pivotal movement of the plates is inclined, leading downward and rearward from an upper end thereof. This condition is best illustrated in FIG. 2. Further, the axis is located within a plane that longitudinally bisects the base member. Thus the vertex of the "V" configuration is centered with the edges 18 and 19.

Figure 3:
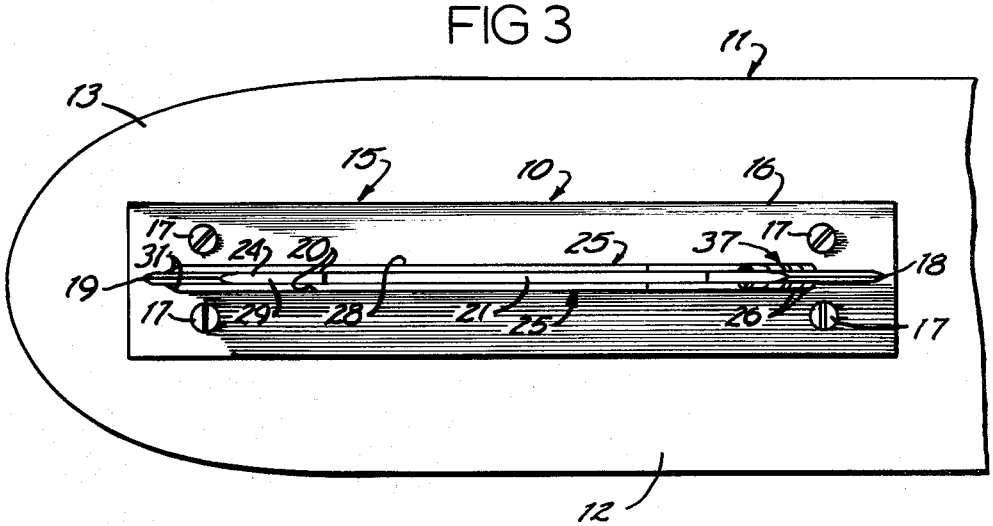
FIG. 3 is a bottom plan view as taken along the plane 3—3 indicated in FIG. 2.

Each plate 25 includes an outer planar surface 28 that extends longitudinally from the hinged recess 23 to a position overlapping a rearward portion of the base member, rearwardly adjacent the relief area 21. The plate may contact portion 24, which acts an an abutment means to prevent pivotal movement beyond portion 24 toward the opposite side of the keel. Both plates include planar inner surfaces 29 that, in the condition as shown in FIG. 3, come into abutment with the base member portion 24.

Plates 25 also include inclined leading edges 30 and oppositely inclined trailing edges 31 (FIG. 2). Edges 30 and 31 are terminated at top and bottom horizontal edges 32 and 33. Thus, each plate takes the form of a trapezoid. Edges 30 and 31 correspond with and are parallel to the leading and trailing edges 18 and 19 of base member 15 respectively.

Figure 4:
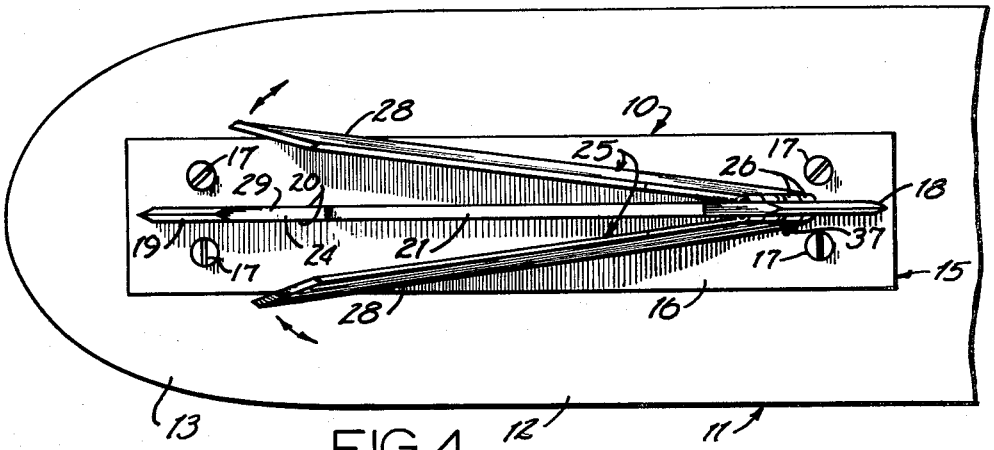
FIG. 4 is a view similar to FIG. 3 only showing the keel plates extended to an operative, low speed configuration.

A resilient biasing means 37 (FIGS. 2 and 6) is utilized to normally urge the pivoted plates 25 apart about the axis of hinge members 26. Biasing means 37 is provided in the simple form of a torsion spring. A coiled portion 39 of the spring is held in position between the hinge members 26 by the pin 27. Arms 40 of the spring extend rearwardly to engage the plate inner surfaces 29 and abut therewith to force the plates apart about the hinge axis. Thus, the normal position for the plates is a V shaped configuration as shown in FIG. 4. This configuration will vary, depending upon the forward speed of the keel through the water, from the condition shown in FIG. 4 to the condition shown in FIG. 3.

The hinge axis is inclined for a distinct reason. As indicated in FIG. 4, when the plates 25 are in the V configuration (spaced apart from a plane bisecting the mounting plate 16), the surfaces 28 are inclined to face somewhat downwardly from a vertical plane. The top edges 32 are thus spaced outwardly from the base 15 and 16 by distances greater than the similar spacing between the base 15 and bottom plate edges 33. This inclination of plates 25 will increase as the plates pivot outwardly from the base member 15. Conversely, the plates will move toward a substantial vertical condition as they move toward the base member 15 (note the plates in FIG. 3). The angular orientation of the plates has a substantial effect on performance of the keel as will be seen below.

Operation of the present keel stabilizing device may now be easily understood from the above technical description.

Operation will be explained in relation to a keel assembly 10 mounted to a slalom water ski 11. Prior to operation, the user will secure his feet within the binding of the ski and at least partially lower himself into the water. The skier must face the rearward end of a towing vehicle and with the ski aligned longitudinally with the intended forward direction of travel. Here the ski is substantially at rest in the water and the torsion spring has little trouble in urging the plates to the outward "V" configuration. The keel performs two helpful functions in assisting the skier to achieve an upright standing position as the towing vehicle begins to pull him forwardly through the water. Firstly, the "V" configuration of the plates serves to stabilize the ski in the longitudinal orientation facing the pulling vehicle. The wedge shape prevents the ski from wobbling laterally in the water as the skier is pulled to an upright condition. Thus, there is less chance that the skier will be thrown off balance while being pulled to a planing condition. Secondly, the plates produce an upward force against the rearward end of the ski to assist in elevating the ski to a planing condition on the water surface. This upward force is created by the water acting against the downwardly inclined plate surfaces 28 when held in the open V configuration.

Figure 5:
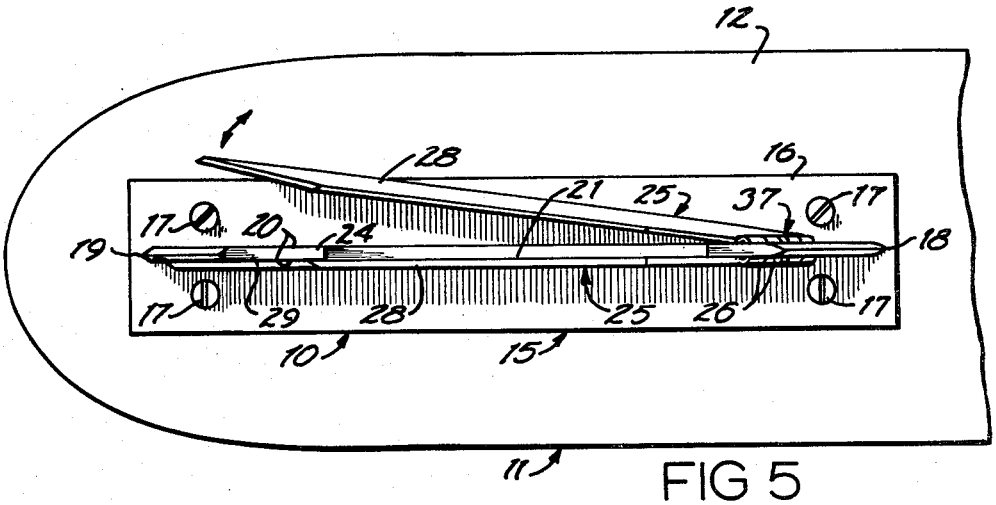
FIG. 5 is a view similar to FIG. 4 only showing the condition of the plates when a turn is encountered during operation of the ski.

After the skier has attained an upright position and has gained velocity behind the towing vehicle, the force of water against the plate surfaces 28 operates against resistance of the biasing means 37 to move the plates to the closed position shown in FIG. 3. Substantially normal resistance (comparable to conventional keels) is then offered by the keel assembly. However, when the skier turns relative to the towing vehicle, water pressure on one side of the keel will be substantially greater than that against the other side. Thus, the condition shown in FIG. 5 may occur. In the turn, the inside plate will be held in the closed condition by abutment with the base member 15 while the remaining plate may pivot slightly outwardly. This outward pivoted plate produces a slight drag on the ski to cause the ski to move in the direction of the turn. This feature is particularly beneficial in slalom type skiing wherein the skier desires to perform relatively tight turns and where, ordinarily, control is greatly reduced when the skier leans into the turn.

It may become evident from the above description and attached drawings that various changes and modifications may be made therein. Many of such changes and modifications, although not shown or previously discussed, are well within the scope of my invention as set forth in the following claims.

What I claim is:

1. A stabilizer keel attachment for a water ski, and the like, having a forward direction of motion relative to the water comprising:

a keel base member having a forward leading edge and a rearward trailing edge and adapted to be mounted to the lower surface of the water ski;

a pair of keel plates;

hinge means on said base member pivotably mounting said keel plates to said base member for pivotal movement of the keel plates about a hinge axis located rearwardly adjacent to the leading edge of the base member, said keel plates being movable between a first outwardly extended position and a second closed position; said keel plates being adapted to be inclined relative to the lower surface of the water ski in said first position and being adapted to be perpendicular to the lower surface of the water ski in said second position;

said hinge axis being located within a plane perpendicular to the lower surface and longitudinally bisecting the base member;

abutment means on said keel base member for preventing pivotal movement of the respective keel plates to opposite longitudinal sides of the base member; and resilient biasing means operatively engaging the keel plates for urging the keel plates to pivot apart from each other into said first position about the hinge axis and for allowing the keel plates to assume said second position in which said keel plates are parallel alongside one another in response to the force of water applied thereto.

2. The keel attachment as set out by claim 1 wherein the base member includes a mounting plate at an upper edge thereof having a flat mounting surface adapted to be fixed to the lower surface of the water ski.

3. The keel attachment as set out by claim 1 wherein the abutment means is integral with the keel base member and is in longitudinal alignment with the hinge axis; and wherein the abutment means comprises a plate perpendicular to the lower surface of the water ski and located in the pivotal paths of the keel plates.

4. The keel attachment as set out by claim 1 wherein the hinge means is inclined forwardly in the intended direction of motion of the ski from a lower rearward end to an upper forward end such that the keel plates will pivot about the hinge axis to become inclined with respect to the keel base member when in their first outwardly extended position and with surfaces thereof leading inwardly and upwardly from their lower edges toward the keel base member.

5. The keel attachment as set out in claim 4 wherein the abutment means is integral with the keel base member and is in longitudinal alignment with the hinge axis; and wherein the abutment means projects into the pivotal path of the keel plates.

6. The keel attachment as set out in claim 1 wherein the biasing means is comprised of a torsion spring operatively connected to the hinge means with arms projecting outwardly to engage the respective keel plates to continuously urge the keel plates apart about the hinge axis.

7. The keel attachment as set out in claim 6 wherein the said hinge axis is inclined forwardly in the intended direction of motion of the water ski from a lower rearward end to an upper forward end such that the keel plates will pivot about the hinge axis to become inclined with respect to the keel base member.

8. The keel attachment as set out in claim 7 wherein the keel plates have oppositely facing longitudinal planar surfaces that are parallel to said hinge axis.

* * * * *